US009517910B2

(12) United States Patent
Jiang et al.

(10) Patent No.: US 9,517,910 B2
(45) Date of Patent: Dec. 13, 2016

(54) CIRCULAR INTEGRATED CASHPOINT MACHINE AND BANKNOTE STACKING APPARATUS THEREFOR

(71) Applicant: GRG Banking Equipment Co., Ltd., Guangzhou, Guangdong (CN)

(72) Inventors: Zhuang Jiang, Guangzhou (CN); En Wu, Guangzhou (CN); Tao Zhang, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/416,601

(22) PCT Filed: Apr. 9, 2013

(86) PCT No.: PCT/CN2013/073930
§ 371 (c)(1),
(2) Date: Jan. 22, 2015

(87) PCT Pub. No.: WO2014/023108
PCT Pub. Date: Feb. 13, 2014

(65) Prior Publication Data

US 2015/0175375 A1 Jun. 25, 2015

(30) Foreign Application Priority Data

Aug. 9, 2012 (CN) ..... 2012 1 0282842

(51) Int. Cl.
*B65H 29/00* (2006.01)
*B65H 29/12* (2006.01)
*B65H 29/40* (2006.01)

(52) U.S. Cl.
CPC ..... *B65H 29/125* (2013.01); *B65H 29/40* (2013.01); *B65H 2404/1416* (2013.01); *B65H 2404/658* (2013.01); *B65H 2701/1912* (2013.01)

(58) Field of Classification Search
CPC ..... B65H 29/40; B65H 2404/1114; B65H 2404/1416; B65H 2404/658
(Continued)

(56) References Cited

U.S. PATENT DOCUMENTS 4,594,502 A * 6/1986 Watanabe ..... G07D 11/0084 209/534
4,925,173 A * 5/1990 Lindblom ..... B65H 29/40 270/52.14
(Continued)

FOREIGN PATENT DOCUMENTS

CN 1496947 A 5/2004
CN 1810616 A 8/2006
(Continued)

OTHER PUBLICATIONS

International Search Report dated Jul. 18, 2013 from corresponding International Application No. PCT/CN2013/073930.

*Primary Examiner* — Howard Sanders
(74) *Attorney, Agent, or Firm* — Wolf, Greenfield & Sacks, P.C.

(57) ABSTRACT

Disclosed is a banknote stacking apparatus comprising at least one pair of transmission assemblies, a hot wheel and a guide plate, wherein the guide plate guides the banknotes to be stacked such that the banknotes are stacked onto a banknote stacking rack. The pair of transmission assemblies comprises a ratchet wheel assembly and a pinch wheel assembly. The ratchet wheel assembly comprises a first transmission wheel, a ratchet wheel and a first conveyer belt stretched over the transmission wheel and the ratchet wheel, wherein the ratchet wheel comprises multiple ratchet teeth. The pinch wheel assembly comprises a second transmission wheel, a pinch wheel and a second conveyor belt stretched over the second transmission wheel and the pinch wheel.
(Continued)

The first conveyor belt and the second conveyor belt form a holding and conveying channel.

4 Claims, 6 Drawing Sheets

(58) Field of Classification Search
USPC ..... 271/187, 315
See application file for complete search history.

(56) References Cited

U.S. PATENT DOCUMENTS

| | | | | |
|---|---|---|---|---|
| 5,775,682 | A * | 7/1998 | Hosking ..... | B65H 29/40 271/119 |
| 5,987,431 | A | 11/1999 | Johnston et al. | |
| 2002/0014736 | A1 | 2/2002 | Katou et al. | |
| 2002/0113366 | A1 | 8/2002 | Watanabe et al. | |

FOREIGN PATENT DOCUMENTS

| | | | |
|---|---|---|---|
| CN | 101096249 | A | 1/2008 |
| CN | 101101682 | A | 1/2008 |
| CN | 201489596 | U | 5/2010 |
| CN | 101894415 | A | 11/2010 |
| CN | 102167240 | A | 8/2011 |
| CN | 202142126 | U | 2/2012 |
| CN | 102381573 | A | 3/2012 |
| CN | 102431823 | A | 5/2012 |
| CN | 202337605 | U | 7/2012 |
| CN | 102819892 | A | 12/2012 |
| DE | 10341588 | A1 | 3/2005 |
| DE | 102010017547 | A1 | 12/2011 |
| JP | 2001052236 | A | 2/2001 |
| JP | 2002348016 | A | 12/2002 |
| JP | 2006206266 | A | 8/2006 |
| JP | 3929762 | B2 | 6/2007 |
| WO | WO 2010/026647 | A1 | 3/2010 |

* cited by examiner

CIRCULAR INTEGRATED CASHPOINT MACHINE AND BANKNOTE STACKING APPARATUS THEREFOR

This application is the national phase of International Application No. PCT/CN2013/073930, filed on Apr. 9, 2013, which claims the benefit of priority to Chinese Patent Application No. 201210282842.1 titled "AUTOMATED TELLER MACHINE AND BANKNOTE STACKING DEVICE THEREOF" and filed with the Chinese State Intellectual Property Office on Aug. 9, 2012, which applications are hereby incorporated by reference to the maximum extent allowable by law.

FIELD OF THE INVENTION

The present application relates to a financial self-service apparatus, in particular, to a banknote stacking device and an automated teller machine in a Cash Recycling System used by a teller in the financial self-service apparatus.

BACKGROUND OF THE INVENTION

In the financial apparatus employing a stacking wheel to stack banknotes, as shown in FIG. 1, two pairs of power clamping wheels 1 are provided at the exit of the banknote conveying passage, each power clamping wheel 1 is fixed on a shaft, and two groups of flat belts 2 and 8 are tensioned on the power clamping wheels. A pair of stacking wheels 4 is provided near the clamping wheels 1, and the two stacking wheels are arranged at an interval. After being moved away from the clamping wheel 1, the banknote 6 is moved at an initial speed; and after being inserted in the stacking wheel 4, the banknote is rotated together with the stacking wheel 4 till it is in contact with the guide plate (not shown), and then is slid downwards along the guide plate. The banknote is moved away from the guide plate at the point a, and finally is orderly stacked on the banknote stacking frame 7. The point a is the intersect point at which the circumferential track of the stacking wheel 4 having the largest radius is intersected with the guide plate.

In the using process of the financial apparatus, the banknote may fly out in cases that the banknote is collided with the end portion of the vane of the stacking wheel, resulting in machine failures such as irregular arrangement of the banknotes and jamming at the entrance of the stacking wheel. It is therefore become a very important task to solve the banknote flying problem.

SUMMARY OF THE INVENTION

In order to solve the banknote flying phenomena existed in the stacking wheel in the prior art, it is provided according to the present application a banknote stacking device, with which the banknotes can be inserted in the stacking wheel more deeply, to thereby prevent the banknotes from flying out.

It is further provided according to the present application an automated teller machine having the banknote stacking device, such that the banknotes are stacked and bundled orderly and efficiently.

The banknote stacking device includes at least a transmission assembly for clamping and conveying banknotes to be stacked from a banknote conveying passage to the banknote stacking device, a stacking wheel for conveying the banknotes in a way that the banknotes are rotated together at a high speed, and a guide plate for guiding the banknotes to be stacked into the stacking wheel and guiding the banknotes to be stacked and conveyed by the stacking wheel to a banknote stacking frame. The transmission assembly includes a ratchet wheel assembly and a clamping and conveying wheel assembly. The ratchet wheel assembly includes a first transmission wheel, a ratchet wheel and a first conveyor belt tensioned on the first transmission wheel and the ratchet wheel. The ratchet wheel includes a drum-shaped wheel on which the first conveyor belt is sleeved and a plurality of ratchets distributed on outer peripheral edges at two ends of the drum-shaped wheel. The clamping and conveying wheel assembly includes a second transmission wheel, a clamping and conveying wheel and a second conveyor belt tensioned on the second transmission wheel and the clamping and conveying wheel. The first conveyor belt and the second conveyor belt form a clamping and conveying passage, and the ratchets can be in contact with banknotes conveyed out of the clamping and conveying passage.

Preferably, the guide plate is provided with protruding ribs for reducing a contact area between the banknote to be stacked and the guide plate.

Preferably, a portion of a surface of each protruding rib located between the transmission assembly and the stacking wheel has an arc-shaped guide surface, for guiding the banknote to be stacked into the stacking wheel.

Preferably, the banknote stacking device includes three clamping and conveying wheel assemblies and two stacking wheels. Each stacking wheel is disposed at a position corresponded to an interspace between each two adjacent clamping and conveying wheel assemblies and near to the banknote stacking frame, and the protruding ribs are arranged longitudinally at two sides of each stacking wheel.

The automated teller machine includes a banknote sorting module, a banknote identification module, a temporary storage module, cashboxes, and a bundling module. The bundling module includes a banknote stacking device, and the banknote stacking device includes at least a transmission assembly for clamping and conveying banknotes to be stacked from a banknote conveying passage to the banknote stacking device, a stacking wheel for conveying the banknotes in a way that the banknotes are rotated together at a high speed, and a guide plate for guiding the banknotes to be stacked into the stacking wheel and guiding the banknotes to be stacked and conveyed by the stacking wheel to a banknote stacking frame. The transmission assembly includes a ratchet wheel assembly and a clamping and conveying wheel assembly. The ratchet wheel assembly includes a first transmission wheel, a ratchet wheel and a first conveyor belt tensioned on the transmission wheel and the ratchet wheel. The ratchet wheel includes a drum-shaped wheel on which the first conveyor belt is sleeved and a plurality of ratchets distributed on outer peripheral edges at two ends of the drum-shaped wheel. The clamping and conveying wheel assembly includes a second transmission wheel, a clamping and conveying wheel and a second conveyor belt tensioned on the second transmission wheel and the clamping and conveying wheel. The first conveyor belt and the second conveyor belt form a clamping and conveying passage, and the ratchets can be in contact with the banknotes conveyed out of the clamping and conveying passage.

Preferably, the guide plate is provided with protruding ribs for reducing a contact area between the banknote to be stacked and the guide plate.

Preferably, a portion of a surface of each protruding rib located between the transmission assembly and the stacking wheel has an arc-shaped guide surface, for guiding the banknotes to be stacked into the stacking wheel.

Preferably, the banknote stacking device includes three clamping and conveying wheel assemblies and two stacking wheels. Each stacking wheel is disposed at a position corresponded to an interspace between each two adjacent clamping and conveying wheel assemblies and near to the banknote stacking frame, and the protruding ribs are arranged longitudinally at two sides of each stacking wheel.

With the arrangement of the ratchet wheel assembly, the ratchets of the ratchet wheel can be in contact with the banknote to be stacked and conveyed from the clamping and conveying passage further, exerting a pushing force to the banknote such that the point at which the banknote to be stacked is actually free from the power of the ratchet wheel gets closer to the stacking wheel. In addition, the contact area between the ratchet and the banknote is small, and thus the resistance is small, which facilitates the insertion of banknotes in the stacking wheel, and thus the depth by which the banknote is inserted in the stacking wheel is increased. Thereby the banknote flying phenomena is reduced. Furthermore, with the arrangement of the protruding ribs on the guide plate, the contact area between the banknote and the guide plate is reduced, and thus the frictional force is correspondingly reduced and the depth by which the banknote is inserted is increased, therefore the banknotes are arranged more smoothly. Meanwhile, with the arrangement of the arc-shaped guide surface on the surface of the protruding rib, the angle at which the banknote is inserted in the stacking wheel is changed, therefore the banknote is directly guided in the interspace between the vanes of the stacking wheel, which can further prevent the banknotes from flying, and therefore the banknotes are stacked orderly and efficiently.

DETAILED DESCRIPTION OF THE INVENTION

Technical solutions in embodiments of the present application will be clearly and fully described below in conjunction with the accompanying drawings in the embodiments of the present application. Apparently, the described embodiments are only a part, but not all, of the embodiments of the present application. All other embodiments obtained by those ordinary skilled in the art based on the embodiments of the present application without any creative efforts fall within the protection scope of the present application.

Figure 1:
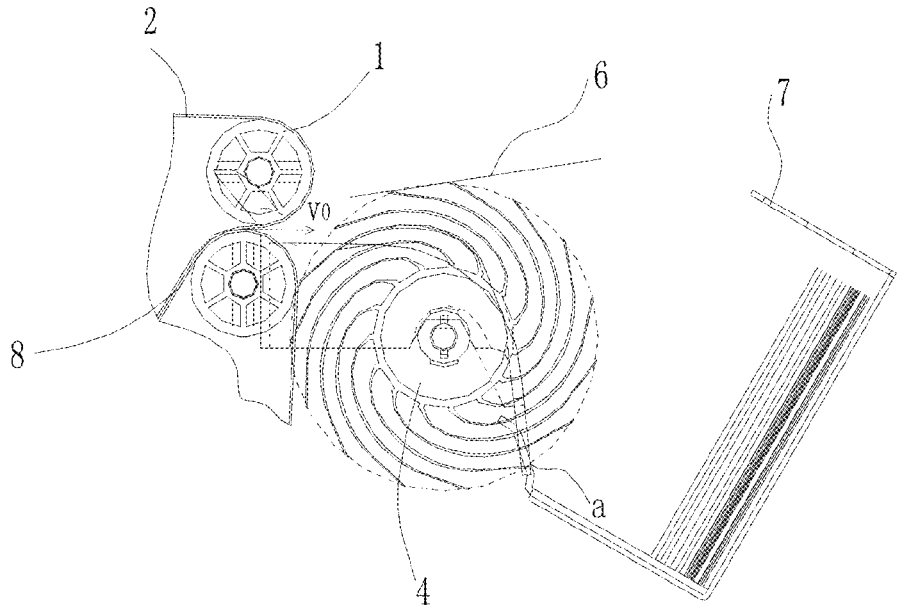
FIG. 1 is a structural schematic view of a banknote stacking device in the prior art.
Figure 2:
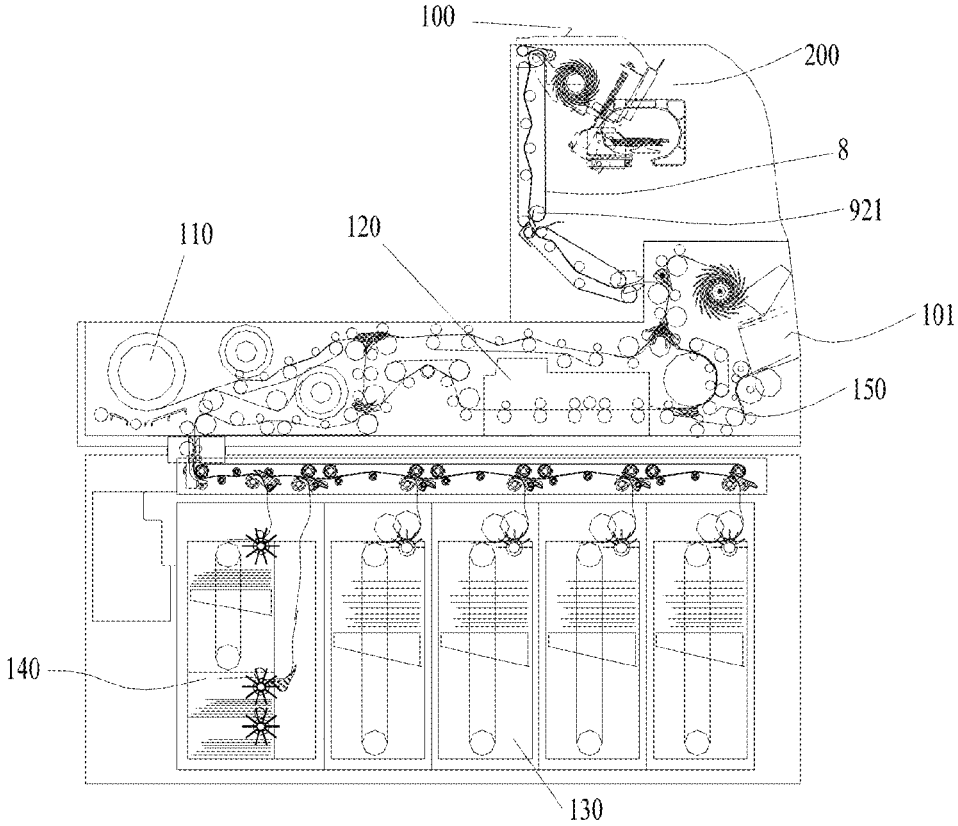
FIG. 2 is a schematic view showing the internal structure of a automated teller machine according to an embodiment of the present application.

Referring to FIG. 2, the automated teller machine according to the present embodiment includes a banknote sorting module 150, a banknote identification module 120, a temporary storage module 110, cashboxes 130 and 140, and a bundling module 200. Banknotes placed in the banknote entrance 101 are sorted by the banknote sorting module 150 and then are moved into the conveying passage in sequence. Banknotes identified by the banknote identification module 120 to be qualified are conveyed into the temporary storage module 110, and are conveyed to a corresponding RC cashbox 130 under the controlling of the program when a customer ensures to deposit the banknotes. While banknotes identified to be unqualified are conveyed to the AC cashbox 140 which is only for depositing. When the customer cancels the depositing, the banknotes are returned to the banknote exit.

When a customer wants to withdraw banknotes by bundles, banknotes are moved to the passage from corresponding RC cashbox 130, and then are conveyed to the banknote identification module 120 in sequence. Then banknotes identified to be unqualified (oblique, torn, or the like) are moved to the temporary storage module 110 under the action of the reversing block; while banknotes identified to be qualified are moved into the bundling module 200. After the bundling process is completed, the unqualified banknotes on the temporary storage module 110 are conveyed to the AC cashbox 140.

Figure 3:
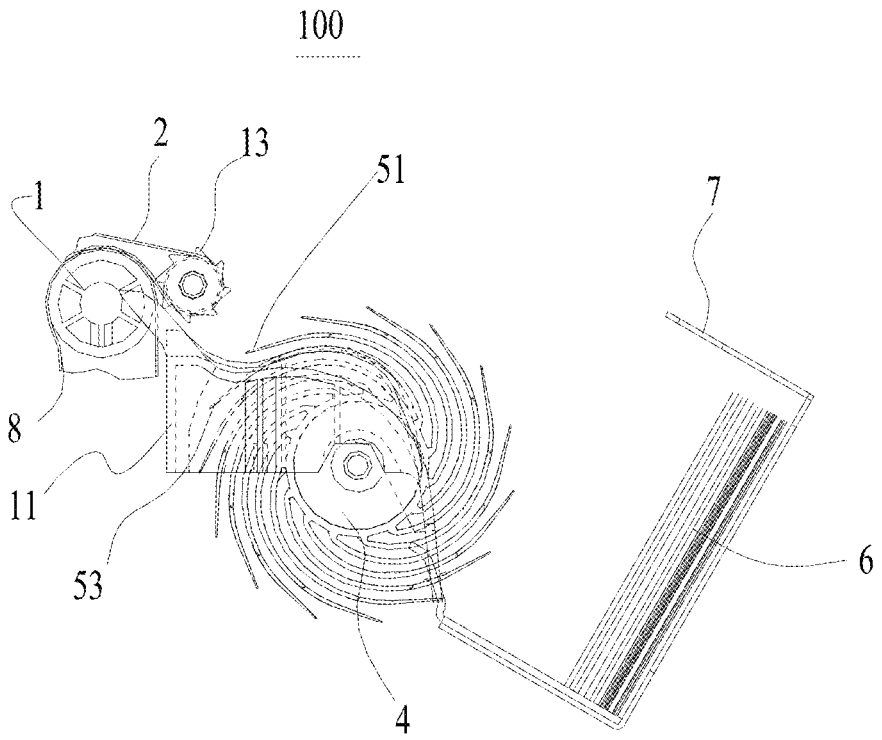
FIG. 3 is a structural schematic view of a banknote stacking device in a bundling module in the automated teller machine shown in FIG. 2.
Figure 4:
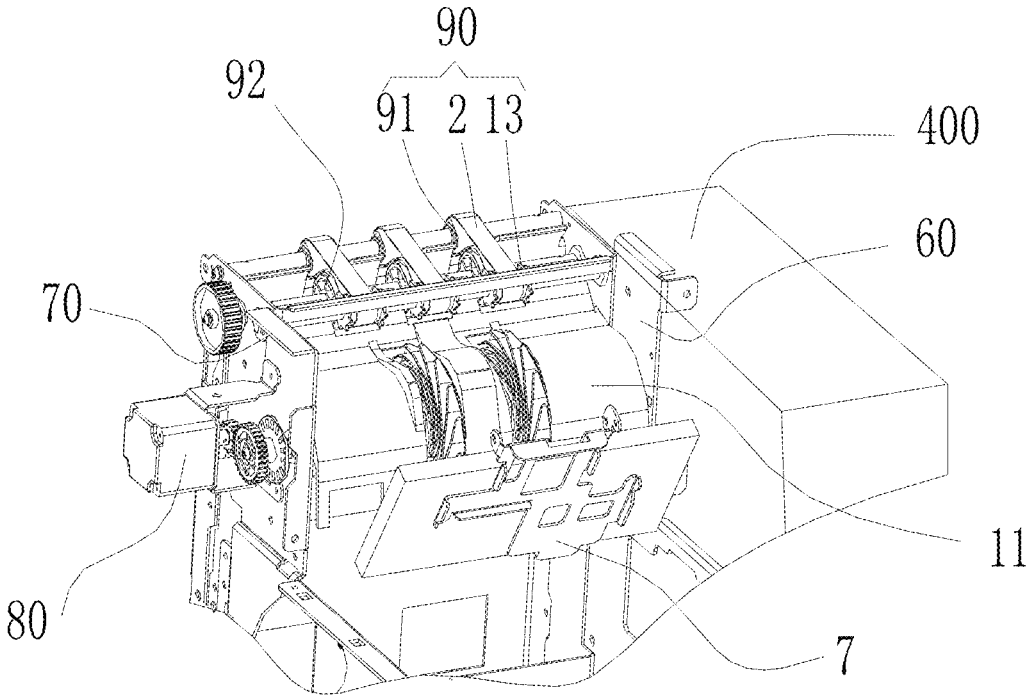
FIG. 4 is a perspective schematic view showing the structure of the banknote stacking device in FIG. 3.

Reference may be further made to FIG. 3 and FIG. 4. After being conveyed into the bundling module 200, the banknotes are clamped and conveyed by the first conveyor belt 2 and the second conveyor belt 8 into the banknote stacking device 100.

The banknote stacking device 100 includes at least a transmission assembly for clamping and conveying banknotes 6 to be stacked from the banknote conveying passage into the banknote stacking device, a stacking wheel 4 for conveying the banknotes in a way that the banknotes are rotated together at a high speed, and a guide plate 11. The guide plate 11 is configured for guiding the banknotes 6 to be stacked into the stacking wheel 4 and guiding the banknotes to be stacked and conveyed by the stacking wheel to a banknote stacking frame 7.

Figure 5:
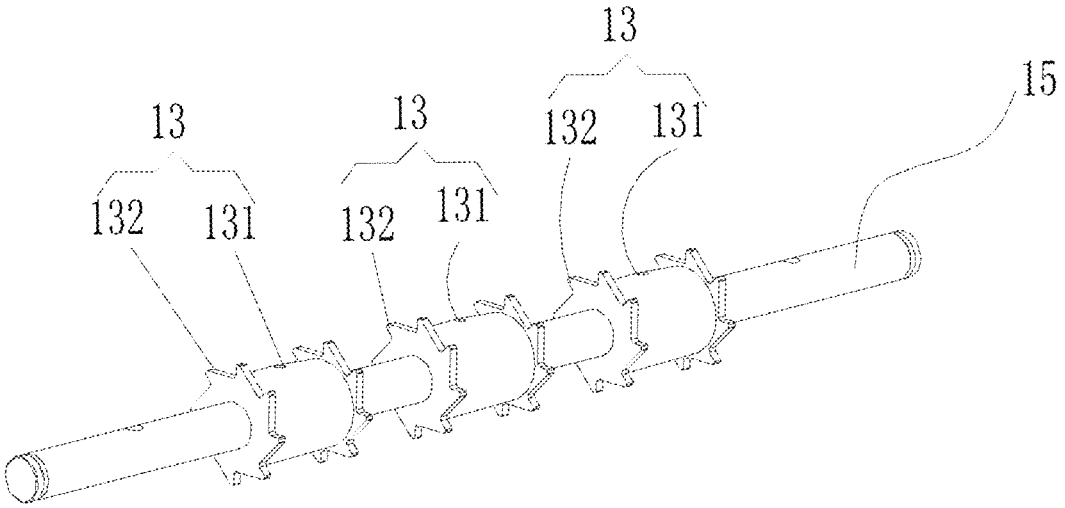
FIG. 5 is a perspective schematic view showing the structure of a ratchet of the banknote stacking device in FIG. 4.

The transmission assembly is arranged at the entrance of the banknote stacking device 100, and includes a ratchet wheel assembly 90 and a clamping and conveying wheel assembly 92. The ratchet wheel assembly 90 includes a first transmission wheel 91, a ratchet wheel 13 and a first conveyor belt 2 tensioned on the first transmission wheel 91 and the ratchet wheel 13. The clamping and conveying wheel assembly 92 includes a second transmission wheel 921 (shown in FIG. 2), a clamping and conveying wheel 1, and a second conveyor belt 8 tensioned on the second transmission wheel 921 and the clamping and conveying wheel 1. In addition, as shown in FIG. 5, the ratchet wheel 13 includes a drum-shaped wheel 131 on which the first conveyor belt 2 is sleeved and a plurality of ratchets 132 distributed on outer peripheral edges at two ends of the drum-shaped wheel. The ratchet wheel 13 is fixedly connected on the transmission shaft 15. The first transmission wheel 91, the transmission shaft 15 of the ratchet wheel 13 and the clamping and conveying wheel assembly 92 are supported by left and right side plates 60 and 70, and are rotatable freely. The first conveyor belt 2 and the second conveyor belt 8 form a clamping and conveying passage, and the ratchets 132 of the ratchet wheel 13 can be in contact with banknotes conveyed out of the clamping and conveying passage, such that the banknotes can be moved forward under actions of the ratchets 132 after moved away from the clamping points at which powers are supplied by the belts 2 and 8, and the banknotes is not blocked, but is helped, by the rotating of the ratchet wheel 13, and are conveyed deeply into spaces between vanes of the stacking wheel behind, so as to prevent the banknotes from flying.

Figure 6:
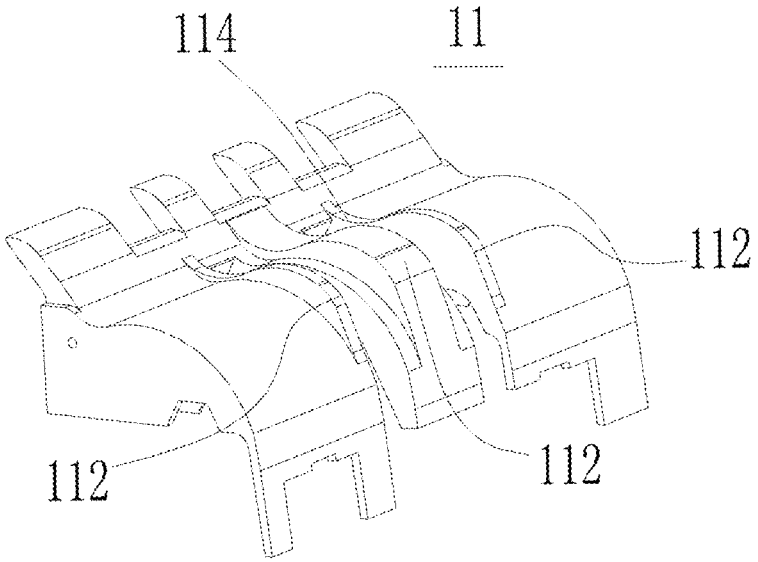
FIG. 6 is a perspective schematic view showing the structure of a guide plate of the banknote stacking device in FIG. 4.

Preferably, as shown in FIG. 6, the guide plate 11 is provided with protruding ribs 112 such that the contact area between the banknote to be stacked and the guide plate is reduced, and therefore the frictional force between the banknote 6 and the guide plate 11 is reduced, the depth that the banknote 6 is inserted into the stacking wheel 4 is increased, and the banknotes are stacked more smoothly. The surface of the protruding rib 112 located between the transmission assembly and the stacking wheel is an arc-shaped guide surface 114, such that the banknote to be stacked are inserted into the stacking wheel 4 after moved out of the clamping and conveying passage formed by the belts 2 and 8. With the arc-shaped guide surface 114, the angle at which the banknote is inserted in the stacking wheel when being moved into the stacking wheel is adjusted, thereby the banknote is deeply inserted, which can further prevent the banknote from flying.

As shown in FIG. 4, in the present embodiment, the banknote stacking device 100 includes three transmission assemblies and two stacking wheels 4. Each transmission assembly includes a ratchet wheel assembly 90 and a clamping and conveying wheel assembly 92, and each transmission assembly form a clamping and conveying passage, in particular, the clamping and conveying passage is formed by the conveyor belts 2 and 8 of the ratchet wheel assembly 90 and the clamping and conveying wheel assembly 92, for conveying the banknote into the stacking wheel 4. Each stacking wheel is disposed at the position corresponded to the interspace between each two adjacent transmission assemblies and near to the banknote stacking frame 7. That is, the stacking wheels 4 are arranged between the transmission assemblies and the banknote stacking frame, such that banknotes conveyed out of the transmission assemblies are conveyed to the banknote stacking frame, and therefore are stacked orderly. Furthermore, it can be appreciated by the skilled in the art that, in order that the banknotes are conveyed smoothly, the two stacking wheels should be symmetrically arranged downstream the transmission assemblies. That is to say, in the case that three assemblies are arranged, the two stacking wheels are symmetrically arranged downstream the interspaces between each two transmission assemblies and are arranged uniformly. Similarly, the protruding ribs 112 are arranged longitudinally at two sides of each stacking wheel, and such a symmetrical arrangement facilitates guiding the banknotes smoothly, such that they are stacked orderly.

Figure 7:
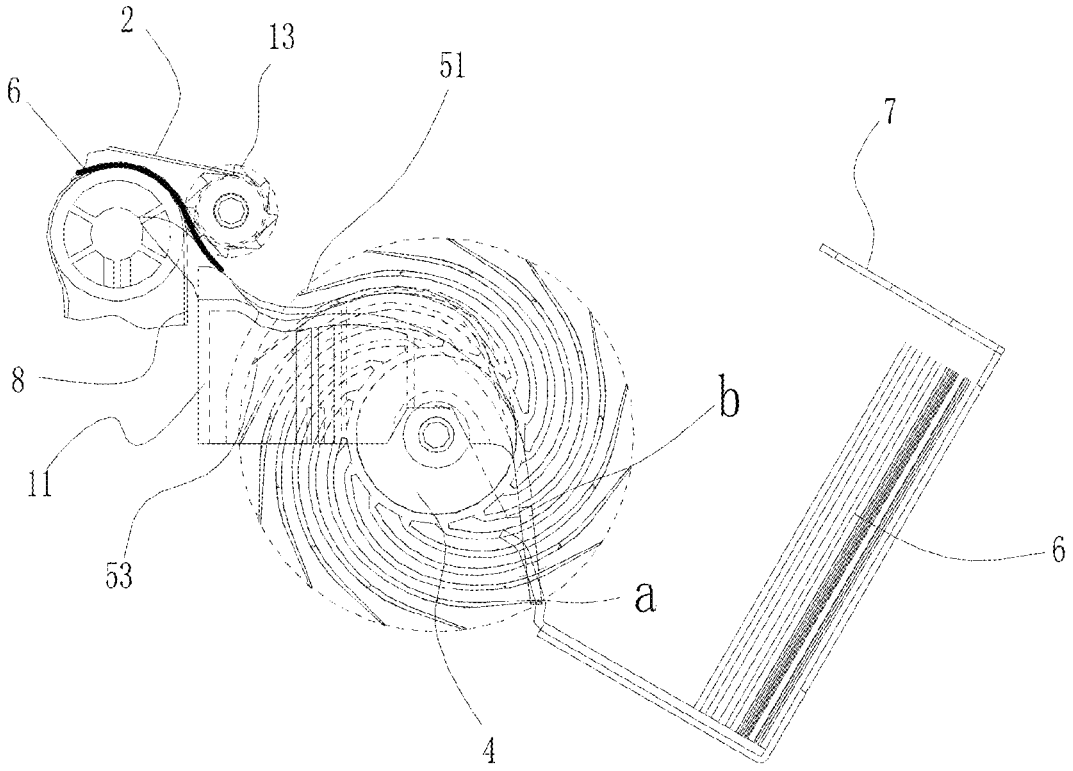
FIG. 7 is a side view showing the time that the banknote is moved in the arc-shaped guiding groove.
Figure 8:
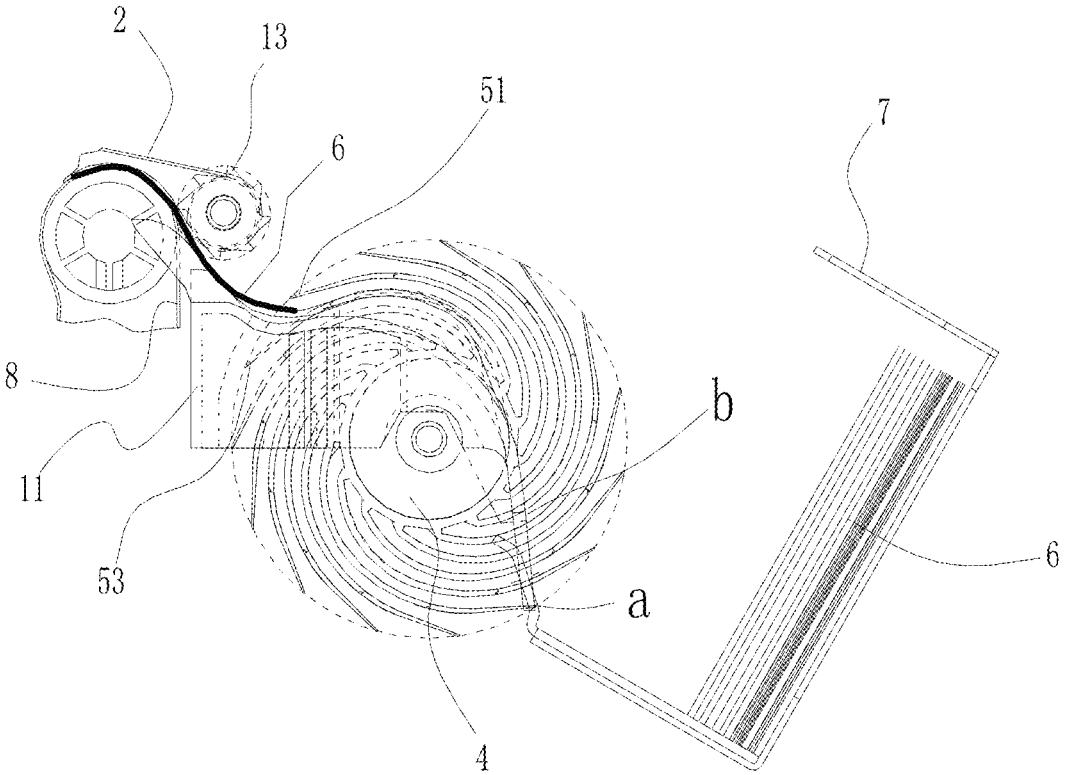
FIG. 8 is a side view showing the time that the banknote is moved in the stacking wheel.

As shown in FIGS. 7 and 8, the banknote is in contact with the guide plate 11 at a speed V0, and is slidingly moved in the space between the vanes 51, 53 of the stacking wheel 4 along the arc-shaped guide surface 114 and the rear segment of the protruding rib 112. At this time, the banknote is only in contact with the protruding rib 112, and thus the frictional force is reduced significantly.

Figure 9:
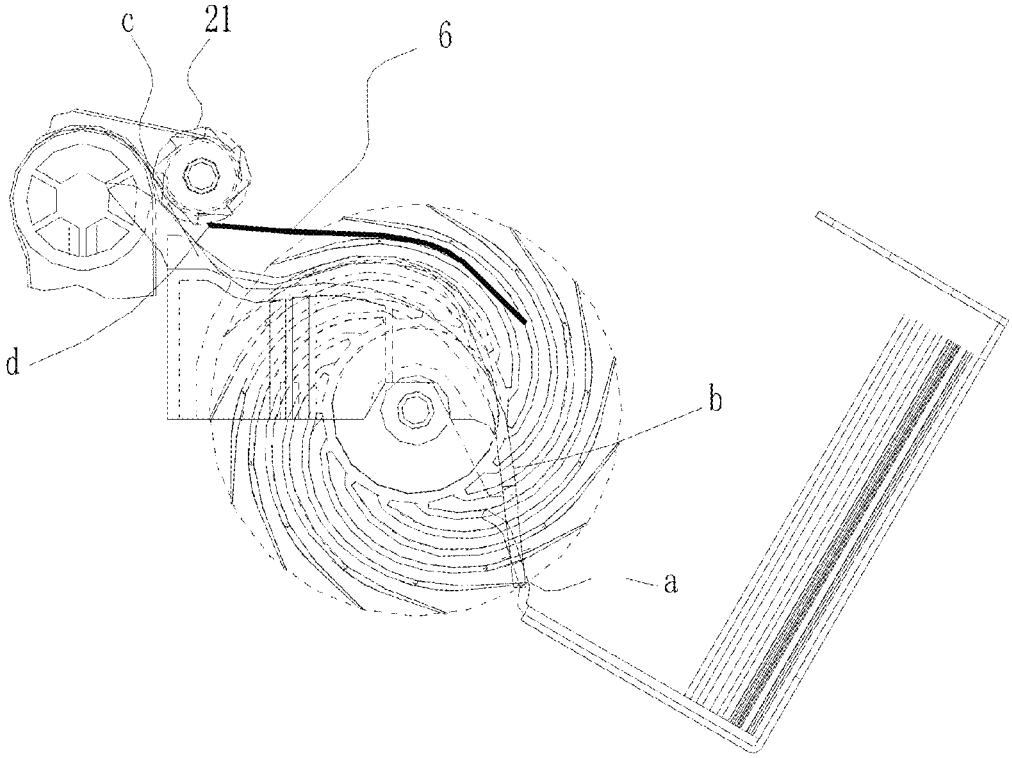
FIG. 9 is a side view showing the time that the banknote is moved away from the ratchet wheel.

As shown in FIG. 9, the banknote 6 is moved forward under the action of the ratchet wheel 13 of the ratchet wheel assembly 90. Since the velocity V1 of the outer circumference of the ratchet wheel 13 is larger than the velocity V0 of the banknote, in the process that the banknote 6 is moved away, the banknote 6 is driven by the ratchet wheel 13 till it is moved away from the track line 21 of the ratchet wheel 13. The point at which the banknote is actually moved away from the ratchet wheel is point d which is close to the stacking wheel. The banknote is driven by the rotation of the ratchet wheel after it is moved away from the point C at which the belts are cooperated, and thus the banknote is more deeply inserted. Thereby, the banknote is conveyed more stably by the stacking wheel 4.

Figure 10:
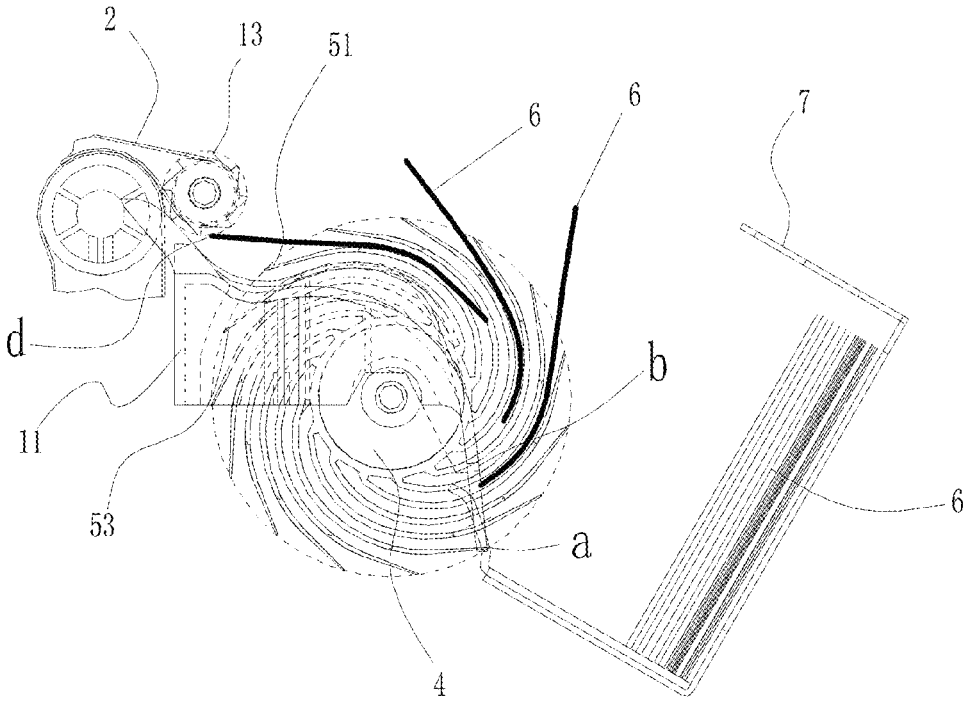
FIG. 10 is a schematic view showing the stacking of the banknotes.

As shown in FIG. 4 and FIG. 10, the stacking wheel 4 is driven by the step motor 80 to rotate at a low speed. The banknote is rotated together with the stacking wheel 4 after being inserted in the stacking wheel 4 till the front end of the banknote 6 is in contact with the guide plate 11, and then is slid, along the guide plate, downwards to point a (the point at which the outer outline of the stacking wheel 4 is intersected with the guide plate 11) and is moved away from the stacking wheel. The initial points b at which banknotes with different widths are brought into contact with the guide plate are different, however, the banknotes are moved away from the stacking wheel at the same point. The upper end of the banknote 6 is firstly in contact with the banknote stacking frame 7, and the lower end of the banknote 6 is slid towards the banknote stacking frame 7 under the gravity till the banknote 6 is closely abutted on the banknote stacking frame 7. As a result, the banknotes are orderly stacked on the banknote stacking frame 7 one by one. In the process of the stacking of the banknotes, the long edges of the banknotes are flapped and the short edges thereof are arranged (the mechanism is not shown in the figures).

As shown in FIG. 2 and FIG. 4, when it is counted by a counter that there are predetermined numbers of banknotes, the banknote stacking frame 7 is lowered at a distance corresponded to the width of the banknotes detected by the banknote identification device 120. The banknotes are then clamped and rotated to a horizontal position by the clamping and conveying mechanism, and then are driven by the step motor (not shown in the figure) into the bundling device 400. After being bundled, the banknotes are conveyed out and turned, and then fell into the banknote exit for bundled banknotes. In this way, the banknotes are stacked and bundled efficiently.

With the arrangement of the ratchet wheel assembly 90, the ratchets 132 of the ratchet wheel 13 can be in contact with the banknote to be stacked and conveyed from the clamping and conveying passage further, exerting a pushing force on the banknote such that the point at which the banknote to be stacked is actually free from the power of the ratchet wheel gets closer to the stacking wheel. In addition, the contact area between the ratchet and the banknote is small, and thus the resistance is small, which facilitates the insertion of banknotes in the stacking wheel, and thus the depth by which the banknote is inserted in the stacking wheel is increased. Thereby the banknote flying phenomena is reduced. Furthermore, with the arrangement of the protruding ribs 112 on the guide plate 11, the contact area between the banknote and the guide plate is reduced, and thus the frictional force is reduced and the depth by which the banknote is inserted is increased, therefore the banknotes are arranged more smoothly. Meanwhile, with the arrangement of the arc-shaped guide surface 114 on the surface of the protruding rib 112, the angle at which the banknote is inserted in the stacking wheel is changed, and therefore the banknote is directly guided in the interspace between the vanes of the stacking wheel, which can further prevent the banknotes from flying.

The above are only preferable embodiments of the present application and are not intended to limit the protection scope of the present application. Any equivalent variations made based on the specification and drawings of the present application should be deemed to fall into the protection scope of the present application.

The invention claimed is:

1. A banknote stacking device, comprising:

at least a transmission assembly for clamping and conveying banknotes to be stacked from a banknote conveying passage to the banknote stacking device;

a stacking wheel for conveying the banknotes in a way that the banknotes are rotated together at a high speed; and a guide plate for guiding the banknotes to be stacked into the stacking wheel and guiding the banknotes to be stacked and conveyed by the stacking wheel to a banknote stacking frame;

wherein, the transmission assembly comprise:

a ratchet wheel assembly comprising a first transmission wheel, a ratchet wheel and a first conveyor belt tensioned on the first transmission wheel and the ratchet wheel, wherein the ratchet wheel comprises a drum-shaped wheel on which the first conveyor belt is sleeved and a plurality of ratchets distributed on outer peripheral edges at two ends of the drum-shaped wheel; and a clamping and conveying wheel assembly comprising a second transmission wheel, a clamping and conveying wheel and a second conveyor belt tensioned on the second transmission wheel and the clamping and conveying wheel; and wherein, the first conveyor belt and the second conveyor belt form a clamping and conveying passage, and the ratchets can be in contact with the banknotes conveyed out of the clamping and conveying passage; and wherein the guide plate is provided with arc-shaped protruding ribs for reducing a contact area between the banknote to be stacked and the guide plate; and wherein a portion of a surface of each protruding rib located between the transmission assembly and the stacking wheel has an arc-shaped guide surface, for guiding the banknote to be stacked into the stacking wheel.

2. The banknote stacking device according to claim 1, wherein the banknote stacking device comprises three clamping and conveying wheel assemblies and two stacking wheels, and wherein each stacking wheel is disposed at a position corresponded to an interspace between each two adjacent clamping and conveying wheel assemblies and near to the banknote stacking frame, and the protruding ribs are arranged longitudinally at two sides of each stacking wheel.

3. An automated teller machine, comprising a banknote sorting module, a banknote identification module, a temporary storage module, cashboxes, and a bundling module, wherein the bundling module comprises the banknote stacking device according to claim 2.

4. An automated teller machine, comprising a banknote sorting module, a banknote identification module, a temporary storage module, cashboxes, and a bundling module, wherein the bundling module comprises the banknote stacking device according to claim 1.

* * * * *